US006311737B2

(12) United States Patent
Wahhoud et al.

(10) Patent No.: US 6,311,737 B2
(45) Date of Patent: Nov. 6, 2001

(54) METHOD AND WEAVING LOOM FOR PRODUCING A LENO GROUND FABRIC

(75) Inventors: Adnan Wahhoud, Lindau-Bodolz; Peter Czura, Wangen, both of (DE); Josef Hehle, Hoerbranz (AU)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 09/773,802

(22) Filed: Feb. 1, 2001

(30) Foreign Application Priority Data

Feb. 2, 2000 (DE) ..... 100 04 376

(51) Int. Cl.[7] ..... D03C 7/00
(52) U.S. Cl. ..... 139/50; 139/52; 139/54
(58) Field of Search ..... 139/54, 52, 50

(56) References Cited

U.S. PATENT DOCUMENTS 3,015,346 * 1/1962 Kaufmann ..... 13/52
6,092,559 * 7/2000 Dvorak et al. ..... 139/50
6,244,304 * 6/2001 Hockemeyer et al. ..... 139/54

FOREIGN PATENT DOCUMENTS 4404451 8/1994 (DE) .
19750804 5/1999 (DE) .
0253451 1/1988 (EP) .
0369525 5/1990 (EP) .
0371257 6/1990 (EP) .
0534629 3/1993 (EP) .
WO99/23288 5/1999 (WO) .

* cited by examiner

*Primary Examiner*—Andy Falik
(74) *Attorney, Agent, or Firm*—W. F. Fasse; W. G. Fasse

(57) ABSTRACT

A leno ground fabric is produced over the entire weaving width of a loom by using two heald frames each having a length corresponding to the weaving width. The heald frames are equipped with a multitude of lifting healds or heddles and with a multitude of half healds or heddles that move the leno warp thread and the ground warp threads for the shed formation over the entire loom width.

16 Claims, 1 Drawing Sheet

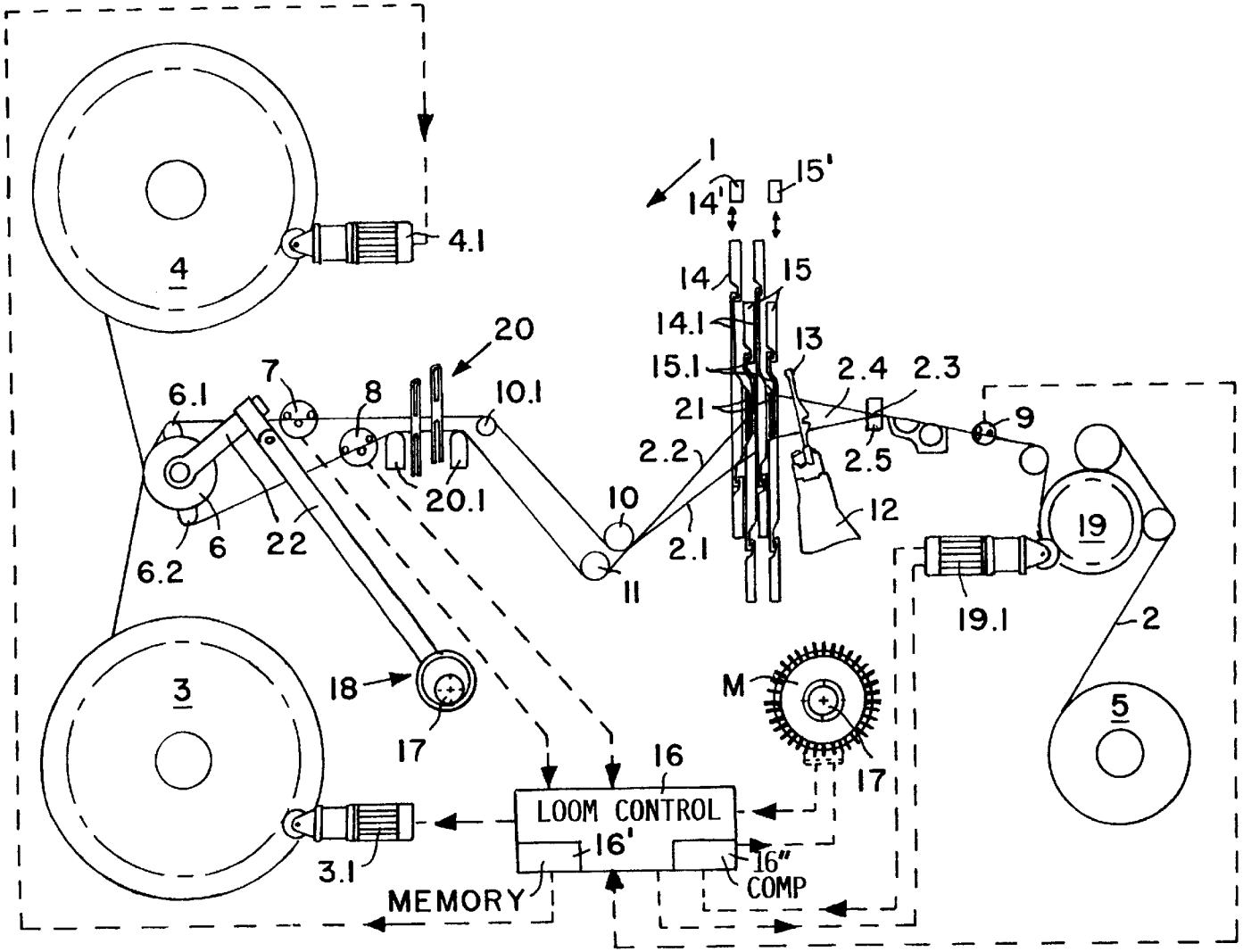
LOOM CONTROL
MEMORY
COMP
1
2
2.1
2.2
2.3
2.4
2.5
3
3.1
4
4.1
5
6
6.1
6.2
7
8
9
10
10.1
11
12
13
14
14.1
14'
15
15.1
15'
16
16'
16"
17
18
19
19.1
20
20.1
21
22
M

METHOD AND WEAVING LOOM FOR PRODUCING A LENO GROUND FABRIC

PRIORITY CLAIM

This application is based on and claims the priority under 35 U.S.C. §119 of German Patent Application 100 04 376.3-26, filed on Feb. 2, 2000, the entire disclosure of which is incorporated herein by reference.

FIELD OF THE INVENTION

The invention relates to producing a leno ground fabric on a weaving loom modified for that purpose.

BACKGROUND INFORMATION

European Patent Publication EP 0,534,629 B1 describes a weaving loom with a first heald frame and a second heald frame. Each heald frame is vertically shiftable or displaceable in shaft guides of the weaving loom. At least one of the heald frames holds a subframe carrying heald shafts or heddles. The subframe is movable back and forth, for example in the first heald frame, in the weft insertion direction. For performing the back and forth motion the subframe is slidably mounted with an axle or support bar extending in the weft insertion direction and slidably mounted on supports of the respective heald frame that holds the subframe. The healds or heddles of the subframe comprise short heddles alternating with long heddles, whereby each short heddle has the shape of a small rail, the free end of which has a reversed head section with a heddle eye for threading a leno thread through the heddle eye. The subframe is hinged to the axle for tilting back and forth between a weaving position and a warp insertion position to facilitate the threading of the leno threads into the heddle eye. The known loom requires a substantial effort and expense for producing a leno fabric because in addition to the conventional oscillating vertical motion sequence of the at least two heddle frames, a motion sequence extending crosswise to the normal vertical motion for moving the subframe in the weft insertion direction is required.

European Patent Publication EP 0,369,525 B1 discloses a method for producing a leno or so-called cross weave fabric including at least one heald frame for the ground warp threads and two heald frames for the leno threads. This type of loom also requires a relatively high effort and expense for the construction and driving elements of the three heald frames.

German Patent Publication DE 197 50 804 C1 discloses a leno selvage apparatus for producing solid or tight selvages with the help of two lifting heddles which are mounted on two heald shafts of a loom. The heald shafts are alternately movable. The selvage forming device further includes a so-called half heald or heddle that cooperates with the two lifting heddles. More specifically, the half heddle is alternately entrained by one or the other lifting heald or heddle in accordance with the motion of the heald frames. The half heddle includes two legs which merge at their upper ends into a head formation provided with an eye for guiding the ground thread. The production of a leno selvage with a leno binding by means of such a combination of two long lifting heddles with a short half heddle is known and does not require any further description.

OBJECTS OF THE INVENTION

It is the aim of the invention to achieve the following objects singly or in combination:

- to produce a leno ground fabric having a width extending over the entire weaving width of a weaving loom and not only over the selvage width;
- to retain the conventional shed formation by means of at least one first and one second heddle frame for producing a leno ground fabric that has a weaving width corresponding to the weaving width capacity of the respective loom; and
- to accomplish the warp thread motions required for the formation of a leno ground fabric with a minimum of components, while avoiding the use of subframes.

SUMMARY OF THE INVENTION

The above objects have been achieved according to the invention by a method which distributes lifting heddles and half heddles which as such are known for weaving a selvage, over the entire weaving width of two heddle frames. According to the invention at least two heddle frames are equipped with a multitude of first lifting heddles for cooperation with half heddles and the number of lifting heddles is the same in both heald frames. Similarly, the number of half heddles is the same in both heald frames. One half heddle will normally cooperate with two lifting heddles. This teaching of the invention has the surprising result that the leno binding conventionally used only for the selvage formation is extended over the entire weaving width for producing a leno ground fabric.

According to the invention the present loom is characterized by at least two heddle frames equipped with lifting heddles and half heddles as mentioned and further equipped with devices for maintaining the required tension of the ground warp thread and of the leno warp thread. By properly controlling the tension in the leno warp thread and in the ground warp thread, the capacity of the loom for the production of leno ground fabric is surprisingly doubled compared to the prior art. For example, according to the prior art it was possible to produce a leno ground fabric having a width of about 2400 mm at a main loom drive r.p.m. of about 200. According to the invention it is now possible to produce a leno ground fabric of the mentioned width on an air jet weft insertion loom at a main drive r.p.m. of more than 450.

According to a further aspect of the invention, the rated warp tension of the ground warp threads is maintained to be larger than the rated warp tension of the leno warp threads. The rated tension of the leno warp threads corresponds to about 40 to 60% of the rated warp tension of the ground warp thread, preferably 50%.

According to the invention, a loom is used that has either a fluidic weft insertion with the help of air or water jets or a mechanical weft insertion with the aid of so-called rapiers, for example. Such looms are equipped with heald frames according to the invention, whereby each of these heald frames carries a multitude of lifting heddles cooperating with respective half heddles distributed over the entire weaving width of the loom.

The shed formation components may comprise a Jacquard machine in combination with a multitude of lifting heddles cooperating with half heddles over the weaving width.

In a preferred embodiment of the invention the leno warp thread is pulled off a respective warp beam over a carding roller to provide for a length compensation in the leno warp thread. Similarly, a length compensation is provided for the ground warp threads, preferably by the same carding roller. The ground warp thread is preferably pulled off a separate warp beam, but runs over the same carding roller. For this purpose the carding roller is equipped with two cams which are preferably extending along the entire length of the carding roller and are positioned on the carding roller diagonally opposite each other. The first cam provides a length compensation in the leno warp thread. The second cam provides a length compensation in the ground warp thread.

More specifically, the length compensation for maintaining the desired constant warp thread tension in the leno warp thread and in the ground warp thread, is accomplished by driving the carding roller with its two cams through an eccentric drive in synchronism with the shed formation or shed change. In this manner the cams as they alternately touch the leno warp threads or the ground warp threads, accomplish a length compensation in the sense that a substantially constant tension force is maintained in the leno warp threads and in the ground warp threads.

Downstream of the carding roller, as viewed in the travel direction of the warp threads, further warp guide or detouring elements are positioned toward the shed forming heddle or heald frames. For controlling the tension force in the leno warp thread and in the ground warp thread tension sensors are positioned in the path of the respective warp threads between the carding roller and the first detouring element. At least one such tension sensor is provided for the respective warp threads for measuring the current or actual warp tension.

The individual sensors are connected with their respective output through respective electrical conductors to a central loom control unit or CPU 16 which has stored in its memory 16' rated warp tension signal values. A comparator 16" compares the measured warp tension signal values with the stored rated warp tension signal values to provide a respective control signal if there is a deviation between the measured and the rated warp tension. The resulting control signals, if there is a deviation, are processed and supplied to the drive of the respective warp beam to provide a closed loop control for the leno warp thread and separately for the ground warp thread withdrawal to maintain the desired warp tension.

It is also possible to measure the warp tension indirectly so that instead of the above described warp tension sensing or additionally thereto, at least one fabric tension sensor may be arranged in the area of the finished fabric between the beat-up line of the fabric and a fabric detouring device. The fabric tension sensor measures the tension in the fabric and thus indirectly the tension in the warp threads. The output of this indirectly measuring fabric tension sensor is also supplied to the central loom control to provide a closed loop control signal if deviations between the rated and actual warp thread tensions are discovered.

It is preferred according to the invention to provide further guide elements between the carding roller and the shed formation heald frames, whereby it is preferred to utilize the rails of a warp stop motion as a warp thread detouring or guiding element.

BRIEF DESCRIPTION OF THE DRAWINGS

In order that the invention may be clearly understood, it will now be described in connection with example embodiments, with reference to the single FIGURE of the accompanying drawing which shows a side view of a schematically illustrated loom equipped according to the invention.

DETAILED DESCRIPTION OF PREFERRED EXAMPLE EMBODIMENTS AND OF THE BEST MODE OF THE INVENTION

A loom 1 modified according to the invention comprises at least one first heald frame 14 and at least one second heald frame 15. Heald frame 14 is equipped with a multitude of lifting heddles 14.1 extending over the entire width or length in the weft insertion direction of the respective heald frame 14. Similarly, heald frame 15 is equipped with an equal multitude of lifting heddles 15.1 also distributed over the length of the heald frame 15 in the weft insertion direction. Conventional drives 14', 15' for moving the respective heald frames 14, 15 up and down are symbolically shown above the lifting heddles 14, 15.

Each of the first and second lifting heddles 14.1 and 15.1 cooperates alternately with a half heddle 21. Thus, the two lifting heddles 14.1, 15.1 in their cooperation with the respective half heddle 21 form in their distribution over the entire weaving width within the heald frames 14 and 15, the shed formation components for forming the loom shed 2.4 for the production of a leno ground fabric 2.

As mentioned according to the invention, a conventional heddle harness with its weaving healds has been replaced by at least two heald frames 14, 15 each equipped with a multitude of lifting heddles 14.1, 15.1 cooperating with half heddles 21 for forming the loom shed 2.4 when weaving a leno ground fabric 2 having a fabric width corresponding to the full loom width capacity.

From weaving leno selvages it is known that the ground thread 2.2 passes through the eye of the half heddle 21 in a leno selvage device. As a result, when the leno selvage shed is changed, the ground thread of the leno selvage is relieved of tension substantially more than the respective leno thread in the leno selvage.

The foregoing problem has been solved according to the invention by a special carding roller 6 provided with first and second cams 6.1 and 6.2 for applying tension to the respective warp thread by lengthening the travel distance of the respective warp thread. Specifically, the cam 6.1 guides the leno warp thread 2.1 and the cam 6.2 guides the ground warp thread 2.2. Preferably, the cams 6.1 and 6.2 are positioned on the carding roller 6 at diametrically opposite positions.

In order to control the rotation of the carding roller 6 with its cams 6.1 and 6.2 for properly regulating the warp tension of the leno warp thread 2.1 and of the ground warp thread 2.2, an eccenter drive 18 for operating the carding roller 6 is coupled to a main loom drive shaft 17 driven by the main loom drive including a motor M. The eccenter cam 18 is so arranged that synchronization of the warp thread tension compensation with the loom shed change is enforced. For this purpose the carding roller 6 is coupled to the eccenter drive 18 by coupling links 22. More specifically, the eccenter drive 18 is so adjusted that the cams 6.1 and 6.2 alternately compensate the warp thread tension reduction resulting form the shed change. When the warp tension is reduced the cams 6.1, 6.2 stretch the respective warp thread.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method for producing a leno ground fabric having a given weaving width, said method comprising the following steps:

a) providing a weaving loom with at least two leno heald frame s each having a frame length corresponding to said weaving width and including a multitude of lifting healds or heddles cooperating with half healds or heddles for forming leno loom sheds extending entirely across said weaving width;

b) supplying to said healds first warps for forming leno warp threads;

c) supplying to said healds second warps for forming ground warp threads;

d) operating said lifting healds and s aid half healds for moving said leno warp threads transversely and up and down so that each leno warp thread alternately crosses a respective ground warp thread from one side of said respective warp thread to the opposite side of said respective warp thread and back again, and for lifting said ground warp threads vertically up and down for repeatedly forming warp sheds, and e) inserting at least one weft thread into each of said warp sheds for weaving said leno ground fabric over the entire weaving width of said weaving loom.

2. The method of claim 1, wherein said supplying steps are performed by withdrawing said leno warp threads and said ground warp threads from respective separate warp beams.

3. The method of claim 1, further comprising measuring a tension of said leno warp threads, comparing a measured leno warp thread tension with a rated leno warp thread tension to provide a leno warp thread tension first control signal, measuring a tension of said ground warp threads, comparing a measured ground warp thread tension with a rated ground warp thread tension to provide a ground warp thread tension second control signal, and selecting said rated ground warp thread tension to be larger than said rated leno warp thread tension.

4. The method of claim 3, wherein said rated leno warp thread tension corresponds to 40% to 60% of said rated ground warp thread tension.

5. The method of claim 1, further comprising using polymeric thread material having a rectangular cross-section for said leno warp threads and for said ground warp threads.

6. A weaving loom for producing a leno ground fabric having a given weaving width, said weaving loom comprising:

a leno thread supply first warp beam, means for driving said first warp beam, a ground thread supply second warp beam, means for driving said second warp beam, at least two heald frames including means for operating said heald frames, said heald frames having a length corresponding to said weaving width, said heald frames comprising a multitude of lifting healds or heddles and half healds or heddles cooperating with said lifting heddles for forming leno loom sheds extending entirely across said weaving width, a driven sley and a reed positioned for cooperation with said heald frame, weft insertion means positioned for inserting at least one weft thread into each of said leno loom sheds, sensors for sensing an actual warp tension in said leno warp threads and in said ground warp threads, and a central loom control including at least one comparator for comparing output signal values from said sensors with rated warp tension signal values to provide warp tension control signals.

7. The weaving loom of claim 6, wherein said heald frame for forming said loom sheds comprise a Jacquard mechanism including said multitude of lifting healds cooperating with said half healds.

8. The weaving loom of claim 6, further comprising warp thread detouring elements for said leno warp threads and for said ground warp threads, said detouring elements comprising at least one carding roller, and wherein said detouring elements are positioned between said warp beams and said shed forming heald frames.

9. The weaving loom of claim 8, wherein said at least one carding roller comprises a first cam (6.1) for a lengths compensation of said leno warp threads and, diametrically opposite said first cam, a second cam (6.2) for a lengths compensation of said ground warp threads.

10. The weaving loom of claim 8, further comprising a main loom drive (M,17) and an eccentric cam drive (18) operatively connected to said at least one carding roller (6) for operating said at least one carding roller in synchronism with said main loom drive.

11. The weaving loom of claim 8, wherein said sensors for sensing an actual warp tension are positioned between said at least one carding roller (6) and said warp thread detouring elements (10, 10.1, 11, 20.1), and wherein said sensors comprise at least one first sensor for sensing leno warp thread tensions and at least one second sensor for sensing ground warp thread tensions.

12. The weaving loom of claim 8, wherein said warp thread detouring elements comprise warp guides of rotational symmetry, said weaving loom further comprising a warp stop motion including stop motion rails (20.1), said rails forming part of said warp thread detouring elements.

13. The weaving loom of claim 6, comprising at least one additional tension sensor (9) positioned for sensing fabric tension, to thereby indirectly measure warp tension.

14. The weaving loom of claim 13, further comprising electrical signal conductors connecting outputs of said first mentioned sensors to said central loom control and for connecting outputs from said additional tension sensor to said central loom control.

15. The weaving loom of claim 6, further comprising separate detouring elements for said leno warp threads and for said ground warp threads.

16. The weaving loom of claim 6, wherein said weft insertion means comprise one of fluidic and mechanic weft insertion devices.

* * * * *